US009962595B2

(12) United States Patent
Ibach

(10) Patent No.: US 9,962,595 B2
(45) Date of Patent: May 8, 2018

(54) AUTOMATIC HEEL UNIT WITH HEEL SUPPORT STRUCTURE

(71) Applicant: Fritschi AG—Swiss Bindings, Reichenbach im Kandertal (CH)

(72) Inventor: Stefan Ibach, Kirchdorf (CH)

(73) Assignee: FRITSCHI AG—SWISS BINDINGS, Reichenbach Im Kandertal (CH)

( * ) Notice: Subject to any disclaimer, the term of this patent is extended or adjusted under 35 U.S.C. 154(b) by 0 days. days.

(21) Appl. No.: 15/347,905

(22) Filed: Nov. 10, 2016

(65) Prior Publication Data

US 2017/0136341 A1 May 18, 2017

(30) Foreign Application Priority Data

Nov. 12, 2015 (EP) ..... 15194299

(51) Int. Cl.
*A63C 9/084* (2012.01)
*A43B 5/04* (2006.01)

(52) U.S. Cl.
CPC ..... *A63C 9/0846* (2013.01); *A43B 5/0496* (2013.01)

(58) Field of Classification Search
CPC ..... A63C 9/0846; A63C 9/084; A43B 5/0496
USPC ..... 280/624, 623
See application file for complete search history.

(56) References Cited

U.S. PATENT DOCUMENTS 4,183,549 A * 1/1980 Salomon ..... A63C 9/0842 280/632
4,746,139 A 5/1988 Dimier et al.
4,971,351 A 11/1990 Flick
5,735,541 A 4/1998 Fritschi et al.
(Continued)

FOREIGN PATENT DOCUMENTS

CH 706664 A1 12/2013
DE 3447012 A1 7/1985
(Continued)

OTHER PUBLICATIONS

Mechanical translation of EP0766930 (Apr. 9, 1997).*

*Primary Examiner* — John D Walters
(74) *Attorney, Agent, or Firm* — Birch, Stewart, Kolasch & Birch, LLP

(57) ABSTRACT

The invention relates to an automatic heel unit (1) for a ski binding, comprising a base (7) for fitting the automatic heel unit (1) on a ski and a heel downholder (3) for holding down a ski boot in a heel region of the ski boot. The heel downholder (3) is mounted so as to be movable in relation to the base (7). The automatic heel unit (1) has a holding configuration in which the heel downholder (3) is located in a holding position and may interact with the heel region of the ski boot that is held in the ski binding in such a manner that the heel region of the ski boot is held down in a lowered position. Furthermore, the automatic heel unit (1) has a step-in configuration in which the heel downholder (3) is located in a step-in position and the heel region of the ski boot is released by the heel downholder (3). The automatic
(Continued)

heel unit (1) comprises a heel support structure (6), which is configured separately from the heel downholder (3), for supporting, in a direction that is horizontally transverse to the ski, the heel region of the ski boot that is held in the ski binding in the holding configuration of the automatic heel unit (1).

15 Claims, 4 Drawing Sheets

(56) References Cited

U.S. PATENT DOCUMENTS

| | | | | |
|---|---|---|---|---|
| 8,820,772 | B2 * | 9/2014 | Andersson | A63C 9/006 280/614 |
| 2014/0217703 | A1 | 8/2014 | Brandl | |
| 2016/0089592 | A1 * | 3/2016 | Damiani | A63C 10/08 280/611 |

FOREIGN PATENT DOCUMENTS

| | | | |
|---|---|---|---|
| EP | 0766930 | A1 | 4/1997 |
| EP | 2452730 | A1 | 5/2012 |
| EP | 2656884 | A1 | 10/2013 |
| EP | 2762209 | A2 | 8/2014 |
| WO | WO 96/23559 | A1 | 8/1996 |

* cited by examiner

AUTOMATIC HEEL UNIT WITH HEEL SUPPORT STRUCTURE

TECHNICAL FIELD

The invention relates to an automatic heel unit for a ski binding, in particular a touring ski binding, comprising a base for fitting the automatic heel unit on a ski and a heel downholder having a heel downholding structure for holding down a ski boot that is held in the ski binding in a heel region of the ski boot. The heel downholder is mounted so as to be movable in relation to the base. The automatic heel unit has a holding configuration in which the heel downholder is located in a holding position and the heel downholding structure may interact with the heel region of the ski boot that is held in the ski binding in such a manner that the heel region of the ski boot is held down in a lowered position. Furthermore, the automatic heel unit has a step-in configuration in which the heel downholder is located in a step-in position and the heel region of the ski boot is released by the heel downholding structure.

PRIOR ART

Automatic heel units of the technical field mentioned at the outset are known. Said automatic heel units in a holding configuration have the task of guaranteeing reliable fixing of the heel region of the ski boot to the ski. Said automatic heel units in a step-in configuration moreover have the task of enabling the ski boot to step into the ski binding. In order for the safety of the skier to be increased, the automatic heel units may moreover also enable safety triggering in which the heel region of the ski boot is released. This here may be a safety triggering in the forward direction, for example, or a lateral safety triggering. In either case, the term "safety triggering" means that the automatic heel unit keeps the heel region of the ski boot locked in the lowered position even in the case of impacts that act on the ski boot, the ski binding, or the ski as long as an energy of the impacts does not exceed a predetermined value. Should the energy of an impact however exceed this predetermined value, the automatic heel unit does release the heel region of the ski boot. Herein it is irrelevant whether the automatic heel unit after having released the ski boot is located in the holding configuration or in the step-in configuration or in any other configuration.

Apart from these tasks, the type of tasks to be assumed by an automatic heel unit typically depend on what function the ski binding, of which the automatic heel unit is a part, is to fulfil. For example, downhill ski bindings are only used for downhill skiing and for skiing on ski lifts. By contrast, touring ski bindings are additionally also used for walking on skis, in particular for climbing with the aid of climbing skins which are fastened to the skis. As opposed thereto, cross-country bindings are used for cross-country skiing, and Telemark bindings are used for skiing using the Telemark technique. From among these ski bindings, downhill ski bindings have only to guarantee reliable fixing of the ski boot to the ski in a so-called holding position and to enable stepping into the ski binding in a so-called step-in position. As opposed thereto, cross-country and Telemark bindings typically have only to keep the ski boot pivotable about an axle that is aligned in a direction that is transverse to the ski, and to enable stepping into the ski binding. By contrast, touring ski bindings, like downhill ski bindings, have to guarantee reliable fixing of the ski boot to the ski in the holding position, and to enable stepping into the ski binding in the step-in position. Additionally however, said touring ski bindings, for walking on skis and/or for climbing, have to be able to hold the ski boot so as to be pivotable about an axle that is aligned in a direction that is transverse to the ski. To this end, touring ski bindings have a climbing position in which the ski boot, as is the case in cross-country bindings and Telemark bindings, is pivotable about an axle that is aligned in a direction that is transverse to the ski, and is raisable from the ski in the heel region, on account of which an articulated movement between the ski boot and the ski is enabled for walking. Depending on the construction and the type of the touring ski binding, the automatic heel unit in the climbing position of the touring ski binding may be located in the holding configuration thereof, in the step-in configuration thereof, or in a climbing configuration that differs therefrom.

Should a holding position be additionally desired in the case of a cross-country and/or Telemark binding, an automatic heel unit by means of which the ski boot in the heel region thereof may be locked so as to be lowered toward the ski, and which may release the heel region of the ski boot for walking in the climbing position of the cross-country and/or Telemark binding, is additionally required in the case of such a cross-country and/or Telemark binding.

In turn, touring ski bindings may be subdivided into three types. The first type of touring ski bindings comprises a ski boot carrier on which the ski boot is held by way of a front jaw and by an automatic heel unit. Herein, the ski boot carrier in the climbing position of the touring ski binding, together with the ski boot that is held therein, is pivotable in relation to the ski, while the automatic heel unit is located in the holding position thereof and locks the heel region of the ski boot so as to be lowered toward the ski boot carrier. By contrast, the ski boot carrier in the holding position of the touring ski binding is locked in an alignment that is substantially parallel with the ski, on account of which the ski boot that is held on the ski boot carrier is correspondingly fixed to the ski. Herein, the automatic heel unit is again located in the holding configuration thereof, and locks the heel region of the ski boot so as to be lowered toward the ski boot carrier. For example, a representative version of this first type of touring ski bindings is described in WO 96/23559 A1 (Fritschi AG Apparatebau). As opposed thereto, the second type of touring ski bindings is based on ski boots having rigid soles. In the case of these touring ski bindings, the ski boot in the toe region thereof is mounted so as to be pivotable in an automatic front unit which is fixedly fitted to the ski. In this case, the automatic heel unit is fixedly attached to the ski at a spacing from the automatic front unit that is adapted to the length of the ski boot sole, and in the holding configuration thereof, or in the holding configuration of the touring ski binding, respectively, locks the ski boot in the heel region. By contrast, the heel of the ski boot in the climbing position of the touring ski binding is released by the automatic heel unit such that the ski boot may be raised from the ski and be pivoted about the mounting on the automatic front unit. The configuration in which the automatic heel unit is located herein is irrelevant, as long as the heel of the ski boot is released by the automatic heel unit and for walking may be repeatedly raised from the ski and be lowered toward the ski again. For example, a representative version of this type of touring ski bindings is described in EP 2 762 209 A2 (Marker Deutschland GmbH). The third type of touring ski bindings, like the first type, comprises a ski boot carrier on which the ski boot is held in the climbing position. To this end, a binding jaw is provided at the front on the ski boot carrier, while only a holding element is provided at the rear on the ski boot carrier. An automatic heel unit which may fix the heel of the ski boot to the ski in the holding position is not disposed on the ski boot carrier but directly on the ski. Therefore, the ski boot in the case of this third type of touring ski bindings in the climbing position is fixed to the ski boot carrier by the front binding jaw and by the holding element, while said ski boot in the holding position of the touring ski binding is held by the front binding jaw and by the automatic heel unit, located in the holding configuration, the sole of the ski boot being aligned so as to be substantially parallel with the ski. For example, a representative version of this type of touring ski bindings is described in CH 706 664 A1 (Fritschi AG-Swiss Bindings).

Thus, automatic heel units which have a holding configuration, a step-in configuration, and optionally a climbing configuration are needed in the case of downhill bindings and in the case of touring ski bindings, and optionally also in the case of cross-country or Telemark bindings.

An example of an automatic heel unit which forms part of the technical field mentioned at the outset is described in WO 96/23559 A1 (Fritschi AG Apparatebau). This automatic heel unit comprises a jaw which in the holding configuration of the automatic heel unit is located in a holding position and encompasses the sole of the ski boot in the heel region at the top and so as to reach laterally somewhat to the front, so as to support the ski boot toward the top and laterally. On account thereof, the ski boot is locked in a lowered position.

A further embodiment of an automatic heel unit having a jaw is described in EP 2 656 884 A1 (Marker). In the case of this automatic heel unit the jaw is configured so as to be U-shaped and in the heel region of the ski boot encompasses a projecting part of the sole of a ski boot from above and laterally. On account thereof, the ski boot is locked in a lowered position.

Both in the case of the jaw of the automatic heel unit of WO 96/23559 A1 as well as in the case of the jaw of the automatic heel unit of EP 2 656 884 A1, the jaw presses from above on the sole and simultaneously holds the ski boot laterally in a direction that is horizontally transverse to the ski. On account thereof, the ski boot is locked in a lowered position as is also known in a pure downhill binding.

Such known automatic heel units have the disadvantage that they either do not allow particularly stable locking of the heel region of the ski boot in the automatic heel unit and thus any sporty skiing style of the skier, or that they do allow a sporty skiing style of the skier but herein are constructed in a very solid and, on account thereof, heavy manner.

In order for ski binding systems to be described, a (fictitious) ski is often used as a reference system, wherein it is assumed that the binding is fitted to this ski. This custom is adopted in the present text. Thus, the term "longitudinal direction of the ski" means along the alignment of the longitudinal axle of the ski. Similarly, "parallel with the ski" in the context of an elongate object means that the latter is aligned along the longitudinal axle of the ski. By contrast, the term "parallel with the ski" in the context of a planar object means that the latter is aligned so as to be parallel with the sliding face of the ski. Furthermore, the term "transverse direction of the ski" or "transverse to the ski" means a direction that is transverse to the longitudinal direction of the ski but that does not necessarily have to be oriented so as to be precisely perpendicular to the longitudinal axle of the ski. The alignment thereof may also deviate somewhat from a right angle. The term "center of the ski" in turn means a center of the ski when viewed in the direction that is transvers to the ski, while the term "fixed to the ski" means not being movable in relation to the ski. Moreover, it is to be noted that some terms which do not include the word "ski" also do refer to the reference system of the (fictitious) ski. Thus, the terms "front", "rear", "top", "bottom", and "lateral" refer to the "front", "rear", "top", "bottom", and "side" of the ski. Likewise, terms such as "horizontal" and "vertical" also refer to the ski, wherein "horizontal" means lying in a plane that is parallel with the ski, and "vertical" means being aligned so as to be perpendicular to this plane

DESCRIPTION OF THE INVENTION

It is an object of the invention to provide an automatic heel unit which is part of the technical field described at the outset, which is of light construction but nevertheless allows a sporty skiing style of the skier.

The achievement of the object is defined by the features of claim 1. According to the invention, the automatic heel unit comprises a forwardly overhanging heel support structure, which is configured separately from the heel downholding structure, for supporting the heel region of the ski boot that is held in the ski binding in the holding configuration of the automatic heel unit only in one direction that is horizontally transverse to the ski, or only both in a direction that is horizontally transverse to the ski as well as in a direction that is downward toward the ski.

Herein, "separately" means that the heel support structure is configured so as to be spatially separated from the heel downholding structure, and that the heel support structure has another function than that of the heel downholding structure. It is irrelevant here whether the heel downholding structure and the heel support structure are disposed on a single common unit, or whether the heel downholding structure and the heel support structure each are disposed on a dedicated unit. Thus, the heel downholding structure and the heel support structure may both be disposed on the heel downholder, for example. However, should the heel downholding structure and the heel support structure each be disposed on a dedicated unit, the heel downholding structure is located on the heel downholder and the heel support structure is disposed on a component that is separate from the heel downholder, for example.

According to the solution according to the invention, the heel downholding structure in the holding configuration of the automatic heel unit supports the heel region of the ski boot that is held in the ski binding in a direction that is vertically upward, so as to be away from the ski. This means that the heel downholding structure in the holding configuration of the automatic heel unit prevents the heel region of the ski boot from freely moving in a direction that is vertically upward, so as to be away from the ski. As opposed thereto, the heel support structure in the holding configuration of the automatic heel unit supports the heel region of the ski boot only in a direction that is horizontally transverse to the ski, or only both in a direction that is horizontally transverse to the ski as well as in a direction that is downward toward the ski. This means that the heel region of the ski boot that is held in the ski binding in the holding configuration of the automatic heel unit is supportable by the heel support structure in relation to movement in one direction, wherein this direction only has a component that is aligned horizontally transverse to the ski, or has both a component that is aligned horizontally transverse to the ski and a component that points vertically toward the ski. Thus, the heel support structure prevents the heel region of the ski boot from moving freely in a direction that is horizontally transverse to the ski and additionally optionally from moving freely in a direction that is downward toward the ski. In any case, the heel region of the ski boot cannot be moved laterally out of the automatic heel unit because of the support through the heel support structure in the holding configuration of the automatic heel unit. Moreover, the heel support structure does not prevent the heel region of the ski boot from moving in a direction that is vertically upward. Consequently, the heel support structure does not assume any function for holding down the heel region of the ski boot.

The specific shape of the forwardly overhanging heel support structure is irrelevant to the solution according to the invention. It is only important that at least one part-region of the heel support structure overhangs toward the front, thus forming an overhang. An overhang herein is to be understood as the projection or protrusion of a part-region of the heel support structure or of the entire heel support structure. The overhang may for example be configured in the form of an elongate body, similar to a bracket or a finger. However, there is also the possibility of the overhang having a round or a domed shape, for example. Likewise, the overhang may also be configured in the form of a vertically aligned rail-type guide. However, the overhang may also be shaped in another manner.

According to the invention, the heel support structure may be configured in such a manner that, in addition to supporting the heel region of the ski boot in a direction that is horizontally transverse to the ski, said heel support structure also enables support downward toward the ski. Such a downward support may be guaranteed by the same region of the heel support structure as that which supports the heel region of the ski boot in a direction that is horizontal to the ski. Likewise, the downward support may also be guaranteed by a region of the heel support structure that is spatially separated from the region of the heel support structure and which enables support of the heel region of the ski boot in a direction that is horizontal to the ski.

However, it is not mandatory herein that the heel support structure is configured for supporting the heel region of the ski boot in a downward manner toward the ski in the first place. There is also the possibility for the heel support structure to only enable support of the heel region of the ski boot in a direction that is horizontally transverse to the ski. In this case, the downward support toward the ski may be performed by a heel-block carrier that is formed separately from the heel support structure. Where this heel-block carrier is disposed on the automatic heel unit is irrelevant herein. Thus, such a heel-block carrier may be disposed in a front lower region of the automatic heel unit, for example. Should the heel support structure of the heel downholder be separately configured, the heel-block carrier may also be disposed on the heel downholder, for example. Moreover however, there is also the possibility of the automatic heel unit not at all having any heel-block carrier by way of which the heel region of the ski boot is supported in a direction that is downward toward the ski.

According to the invention, the heel downholding structure in the holding configuration of the automatic heel unit may hold down the heel region of the ski boot that is held in the ski binding in a lowered position. Furthermore according to the invention, the heel support structure in the holding configuration of the automatic heel unit may support the heel region of the ski boot that is held in the ski binding in a direction that is horizontally transverse to the ski. Herein, both the heel downholding structure as well as the heel support structure substantially interact with that region of the ski boot in which the heel of the skier is located. However, this does not preclude individual regions of the heel downholding structure and/or of the heel support structure from potentially reaching beyond the heel region of the ski boot to the front in the direction of the toe region of the ski boot.

The advantage of the achievement according to the invention lies in that the heel support structure is separated from the heel downholding structure. This leads to that region of the automatic heel unit that assumes the function of supporting the heel region of the ski boot in a direction that is horizontally transverse to the ski and additionally optionally in a direction that is downward toward the ski is spatially separated from that region of the automatic heel unit that assumes the function of holding down the heel region of the ski boot. By virtue of this separation of functions the heel support structure may be better optimized in terms of supporting the heel region of the ski boot in a direction that is horizontally transverse to the ski and additionally optionally in a direction that is downward toward the ski. This enables the heel support structure to be constructed so as to be narrower and thus more space saving as well as lighter than when the heel support structure is not configured separately from the heel downholding structure. A light ski binding enhances the skiing comfort of the skier as well as the comfort when transporting the skis having the ski binding fitted to the former. Moreover, supporting the heel region in a direction that is horizontally transverse to the ski may also be performed closer to the ski by way of the heel support structure that is configured separately from the heel downholding structure. On account thereof, the center of gravity of the automatic heel unit may be repositioned so as to be closer to the ski, on the one hand. On the other hand, the skiing comfort of the skier may also be enhanced on account thereof, because the skis can be better controlled when skiing.

Should the automatic heel unit moreover enable safety triggering and have an elastic element so as to bias the heel region of the ski boot together with the heel downholder and the heel downholding structure toward the ski such that the heel region of the ski boot is held down, by way of the space saving construction of the heel support structure a comparatively large elastic element may be used without herein having to construct the automatic heel unit in a larger manner. On account thereof, a greater bias having correspondingly higher trigger values may be achieved for the ski binding, this increasing safety in particular in the case of a sporty skiing style of the skier such as in the case of so-called freeriding, for example.

The heel downholder is preferably movable from the holding position thereof to the step-in position thereof and back to the base, so as to adjust the automatic heel unit from the holding configuration to the step-in configuration and back. It is irrelevant herein in which direction the heel downholder for adjusting the automatic heel unit is movable in relation to the base. This has the advantage that the automatic heel unit may be constructed so as to be adjustable from the holding configuration thereof to the step-in configuration thereof and back in a simple manner. In one preferred embodiment, the heel downholder is movable in relation to the base in a plane that is vertically aligned in the longitudinal direction of the ski, so as to adjust the automatic heel unit from the holding configuration to the step-in configuration and back. This has the advantage that the skier may downwardly adjust the automatic heel unit in a simple manner from above, for example using a ski pole, from the holding configuration to the step-in configuration and back.

Alternatively however, there is also the possibility for the heel downholder during adjustment of the automatic heel unit from the holding configuration to the step-in configuration and back to not be movable in relation to the base.

The automatic heel unit preferably comprises an elastic element by way of which the heel downholder in the holding position thereof together with the heel downholding structure is downwardly biased such that the heel region of the ski boot that is held in the ski binding is pushed, down by the heel downholding structure and, on account thereof, is held down. It is irrelevant herein whether the heel downholder is downwardly biased in its entirety or only by way of a region in which the heel downholding structure is located. Independently thereof, it is ensured by the biasing that the heel downholding structure in the case of heel regions of ski boots having dissimilar dimensions is at all times in contact with the heel region of the ski boot and pushes the latter down in an optimal manner. Moreover, the biasing has the advantage that, should safety triggering be provided, an optimally controlled safety triggering may be enabled in that the heel downholding structure has first to be moved counter to the force that is generated by the biased elastic element until safety triggering occurs.

In one variant, however, there is also the possibility for the heel downholder in the holding position thereof together with the heel downholding structure to be biased by the elastic element in another direction such as upward or in a lateral direction, for example.

Alternatively, there is also the possibility for the automatic heel unit to not comprise any elastic element by way of which the heel downholder in the holding position thereof together with the heel downholding structure is biased. In this case, the heel downholder together with the heel downholding structure may be configured so as to be lockable, for example by way of a latching mechanism, in the holding position and in the step-in position.

The heel support structure is preferably shaped such that the latter in the holding configuration of the automatic heel unit in a direction that is horizontally transverse to the ski always interacts with the heel region of the ski boot in a form-fitting manner on both sides. Herein "form-fitting in a direction" and/or "form-fitting in directions" means that at least one connection region of the heel support structure and at least one connection region of the heel region of the ski boot mutually engage in such a manner that a mechanical connection which prevents the heel region from moving in relation to the heel support structure in the indicated direction or directions and which also in the case of an uninterrupted force transmission between the connection region of the heel support structure and the connection region of the heel region of the ski boot is not releasable by movement of the heel region in relation to the heel support structure in the indicated direction or indicated directions is created. Herein, the form-fitting connection may allow or likewise prevent the heel region moving in relation to the heel support structure in other directions. In one preferred variant thereof, the heel support structure may also be shaped in such a manner that the former in the holding configuration of the automatic heel unit interacts in a form-fitting manner with the heel region of the ski boot in directions within an angular range, preferably within an angular range from −45° to +45° in relation to the direction that is horizontally transverse to the ski. During the entire time in which the automatic heel unit is located in the holding configuration and in which the heel downholding structure interacts with the heel region of the ski boot that is held in the ski binding in such a manner that the heel region of the ski boot is held down in the lowered position, the heel support structure by way of the at least one connection region thereof thus interacts on both sides with the connection region of the heel region of the ski boot in a completely form-fitting manner. This means that even in the case of lateral forces arising, which may be created when skiing, the heel support structure at all times is in contact with the heel region of the ski boot on both sides of the ski boot and interacts with said heel region in a form-fitting manner. It is irrelevant herein whether the connection region of the heel support structure extends across the entire heel support structure or only over a part thereof. The form-fitting interaction offers the advantage that the heel region, even in the case of great forces and in the case of an uninterrupted force transmission between the heel support structure and the heel region of the ski boot, is securely supported in a direction that is horizontally transverse to the ski. Moreover, the heel region of the ski boot may not be unintentionally released laterally from the automatic heel unit even in the case of a shock or in the case of vibrations. This enhances the safety of the skier.

Alternatively, there is also the possibility for the heel support structure in the holding configuration of the automatic heel unit to not always interact on both sides with the heel region of the ski boot in a form-fitting manner in a direction that is horizontally transverse to the ski. In one such embodiment, the heel support structure may interact with the heel region by way of a straightforward force-fitting connection, for example.

The heel region of the ski boot preferably has a mating structure, wherein the heel support structure of the automatic heel unit is configured for interacting with the mating structure of the heel region of the ski boot. This has the advantage that the heel region of the ski boot may be held in an optimal manner in the automatic heel unit. However, the heel support structure is preferably configured for interacting with the mating structure of the heel region of the ski boot in a form-fitting manner such that the heel region of the ski boot is supportable always on both sides in the automatic heel unit in a form-fitting manner by the heel support structure in a direction that is horizontally transverse to the ski. This has the advantage that the heel region of the ski boot may be held in an optimal and secure manner in the automatic heel unit even in the case of abruptly arising forces or vibrations, for example, since the heel support structure and the mating structure of the heel region of the ski boot are mutually engaged.

Alternatively, the heel region of the ski boot has no mating structure. In this case, the heel support structure interacts with one or a plurality of external faces of the heel region of the ski boot.

The heel support structure is advantageously configured, in the holding configuration of the automatic heel unit, for holding the heel region of the ski boot that is held in the ski binding in a direction that is horizontally transverse to the ski in relation to the heel downholding structure. In that the heel support structure holds the heel region of the ski boot, the heel support structure prevents the heel region of the ski boot from freely moving in a lateral direction in relation to the heel downholding structure, that is to say in a direction that is horizontally transverse to the ski. This offers the advantage that the heel region of the ski boot during skiing cannot freely move in relation to the heel downholding structure in a direction that is horizontally transverse to the ski in the case of forces arising, on account of which the skiing comfort of the skier is enhanced. Should the automatic heel unit moreover enable safety triggering in the forward direction, safety triggering in the forward direction is optimized by holding the heel region of the ski boot in relation to the heel downholding structure, since the energy that may be absorbed by the automatic heel unit until safety triggering occurs is more accurately defined in the various situations which may arise during skiing.

In one first preferred variant thereof, the heel support structure is configured, in the holding configuration of the automatic heel unit, for allowing movement of the heel region of the ski boot that is held in the ski binding in a direction that is horizontally transverse to the ski within a limited region in relation to the heel downholding structure. This has the advantage that the energy from heavy shocks and impacts which during skiing act on the ski, the ski boot, or the ski binding, in a direction that is horizontally transverse to the ski are able to be absorbed well. Herein, the length of the limited region in a direction that is measured horizontally transverse to the ski is preferably at most 2 mm, more preferably at most 1 mm, and particularly preferably at most 0.5 mm. This has the advantage that the heel region of the ski boot may be introduced into the automatic heel unit in a simple manner when stepping into the ski binding and adjusting the automatic heel unit to the holding configuration. However, the limited region may also have a length greater than 2 mm. Independently of the length of the limited region, the heel support structure in one preferred variation in the transverse direction of the ski is immovable in relation to the heel downholding structure, or is movable at most within the production tolerances, respectively, wherein the heel region of the ski boot that is held in the ski binding in the holding configuration of the automatic heel unit is movable in relation to the heel support structure as well as in relation to the heel downholding structure in a direction that is horizontally transverse to the ski within the limited region. By contrast however, the heel support structure in another preferred variant thereof is movable in relation to the heel downholding structure in a direction that is horizontally transverse to the ski within a limited range of movement. Herein, the sum of the length of the limited range of movement in the direction that is measured horizontally transverse to the ski, plus the length across which in the holding configuration of the automatic heel unit the heel region of the ski boot that is held in the ski binding is movable in relation to the heel support structure in the direction that is horizontally transverse to the ski, corresponds to the length of the limited region measured in the direction that is horizontally transverse to the ski.

In a second preferred variant of the heel support structure that is configured for holding the heel region, the heel support structure in the holding configuration of the automatic heel unit is configured for blocking movement of the heel region of the ski boot that is held in the ski binding in a direction that is horizontally transverse to the ski in relation to the heel downholding structure. In this case, the heel region of the ski boot that is held in the ski binding is not movable, or only movable within a region, respectively, in relation to the heel downholding structure, which region results from the production tolerances of the heel support structure and of the heel downholding structure. Herein, the heel support structure in relation to the heel downholding structure in the transverse direction to the ski is also immovable or movable at most within the production tolerances. This allows a reliable connection between the heel support structure and the heel region of the ski boot, and between the heel downholding structure and the heel region of the ski boot even when high shock-type forces and very heavy vibrations act thereon. On account thereof, the skier when skiing may have better control of the ski, increasing the safety of the skier.

Alternatively, there is also the possibility for the heel support structure to not hold the heel region of the ski boot in a direction that is horizontally transverse to the ski. The heel region then may be mounted so as to be freely movable in a direction that is horizontally transverse to the ski, for example.

The forwardly overhanging heel support structure in the holding configuration of the automatic heel unit is preferably configured for engaging in a clearance in the heel region of the ski boot that is held in the ski binding, so as to support the heel region of the ski boot that in the holding configuration of the automatic heel unit is held in the ski binding only in a direction that is horizontally transverse to the ski, or only both in a direction that is horizontally transverse to the ski as well as in a direction that is downward toward the ski. This offers the advantage that the heel region of the ski boot may be optimally supported by the heel support structure. Herein, the forwardly overhanging heel support structure is particularly preferably shaped in such a manner that the former in the holding configuration of the automatic heel unit in a direction that is horizontally transverse to the ski always interacts with the counterpart structure of the heel region of the ski boot in a form-fitting manner on both sides. This allows a reliable connection between the automatic heel unit and the heel region of the ski boot, and reliable support of the heel region of the ski boot in a direction that is horizontally transverse to the ski. However, there is also the possibility for the heel support structure to not be shaped in such a manner that the latter in the holding configuration of the automatic heel unit in a direction that is horizontally transverse to the ski always interacts with the heel region of the ski boot in a form-fitting manner on both sides. Likewise, the heel support structure may also be configured differently than for engaging in a clearance in the heel region of the ski boot that in the holding configuration of the automatic heel unit is held in the ski binding.

The heel support structure is preferably disposed on the heel downholder. Herein, the heel support structure which is configured separately from the heel downholding structure may be located on the same element as the heel downholding structure, or else on another element of the heel downholder. A heel support structure that is disposed on the heel downholder offers the advantage that a compact construction mode of the automatic heel unit is enabled despite the heel support structure being configured separately from the heel downholding structure.

Should the heel support structure be disposed on the heel downholder, the heel downholding structure and the heel support structure are preferably configured on the same element. This allows an even more compact construction mode, and simplifies the manufacturing and fitting of the automatic heel unit since the automatic heel unit comprises fewer individual parts.

As an alternative to disposing the heel downholding structure and the heel support structure on the same element, there is however also the possibility for the heel support structure to indeed be disposed on the heel downholder, but to be configured on another element of the heel downholder than the heel downholding structure. It is to be understood in this case that the heel downholder comprises more than one element. A construction mode of this type has the advantage that the element having the heel support structure, and the element having the heel downholding structure may be manufactured in a simpler manner. This advantage applies independently of whether the heel downholding structure is configured on a single element of the heel downholder, or extends across more than one element of the heel downholder. This advantage likewise applies independently of whether the heel support structure is configured on a single element of the heel downholder, or extends across more than one element of the heel downholder.

In one preferred variant for disposing the heel support structure on the heel downholder, the heel support structure is configured separately from the heel downholder. The heel support structure then is preferably configured on a unit of the automatic heel unit that is disposed separately from the heel downholder. This offers the advantage that the heel downholder may be fitted in a manner that is entirely independent of the heel support structure, for example, and that the heel downholder if required may be configured so as to be adjustable, or may be constructed so as to be replaceable if required.

Independently of whether the heel support structure is disposed on the heel downholder, or is configured separately from the heel downholder, the heel downholding structure is preferably fixedly disposed in relation to the heel support structure. This means that the heel downholding structure, when viewed from the heel support structure, in relation to the heel support structure is always disposed at the same spacing therefrom and in the same spatial angle thereto, and is aligned in the same manner to the heel support structure, while the heel support structure, when viewed from the heel downholding structure, in relation to the heel downholding structure is always disposed at the same spacing therefrom and at the same spatial angle thereto, and is aligned in the same manner to the heel downholding structure. Thus, the heel downholding structure and the heel support structure in spatial terms may indeed be moved and rotated. However, in mutual terms, neither the spacing, the position, nor the alignment thereof change. This has the advantage that the automatic heel unit has fewer movable parts, enabling cost-effective manufacturing and simple fitting. In order for this advantage to be further reinforced, the heel downholder together with the heel downholding structure may also be fixedly connected to the heel support structure.

In one preferred variant thereof, the heel downholding structure is movable in relation to the heel support structure. It is irrelevant herein in which direction the heel downholding structure is movable in relation to the heel support structure, and whether the movement takes place in the three-dimensional space or in one plane. It is furthermore irrelevant whether the movement is linear or curved, or includes any rotation. Independently of the type of movement, this has the advantage that a spacing between the heel support structure and the heel downholding structure, for example, is variable so as to adapt the automatic heel unit to dissimilar ski boot sizes, or in order to facilitate stepping in for various ski boot sizes. A heel downholding structure that is movable in relation to the heel support structure furthermore offers the advantage that, should safety triggering be provided, the heel downholding structure in the case of safety triggering may be moved independently of the heel support structure, or the heel support structure may be moved independently of the heel downholding structure, respectively, so as to release the ski boot from the automatic heel unit. On account thereof, the direction in which the ski boot moves upon being released may be predefined by the non-moving heel support structure or heel downholding structure, respectively. This allows more controllable safety triggering and enhances the safety of the skier.

The heel downholding structure is preferably movable in relation to the heel support structure in a plane that is vertically aligned in the longitudinal direction of the ski. This has the advantage that the automatic heel unit may be constructed such that stepping into the automatic heel unit with the ski boot using a downward movement of the ski boot from above is facilitated. Alternatively, the heel downholding structure in relation to the heel support structure may also be movable in a plane that is differently aligned, or in the three-dimensional space.

Should the heel downholding structure be movable in relation to the heel support structure, and the heel support structure be disposed on the heel downholder, the heel downholding structure preferably extends across one or a plurality of elements of the heel downholder that are separate from the heel support structure, the heel downholder structure being movable in relation to the latter. Herein there is the possibility for the heel support structure to be configured on a single element, or for the heel support structure to extend across a plurality of elements that are all configured separately from the heel downholding structure. This has the advantage that the heel downholding structure may be configured in a simple manner so as to be movable in relation to the heel support structure.

Should the heel downholding structure be movable in relation to the heel support structure, and the heel support structure be configured separately from the heel downholder, the heel downholder is preferably movable in relation to the heel support structure. This has the advantage that the spacing of the heel downholder from the heel support structure is variable, on account of which stepping into the automatic heel unit may be facilitated.

A cross section that runs horizontally through the forwardly overhanging heel support structure advantageously has a forward pointing bracket. It is irrelevant herein whether the bracket points exactly to the front toward the tip of the ski, or whether the bracket is laterally angled in relation to the longitudinal axle of the ski. Preferably, the bracket when viewed in the longitudinal direction of the ski has a larger extent than when viewed horizontally in the transverse direction of the ski. Thus, the bracket when viewed in the longitudinal direction of the ski may have the shape of an elongate body, similar to that of a finger, peg, or pin, for example. Independently of the specific shaping thereof, the forward pointing bracket has the advantage that, in the holding configuration of the automatic heel unit, simple engaging of the forward pointing bracket in a clearance in the heel region of the ski boot that is held in the ski binding is enabled.

By contrast, in one preferred variant of a bracket, a cross section that runs horizontally through the heel support structure, has a forward pointing burl as an overhang. The burl herein may be configured so as to be semi-circular, for example. Alternatively, the burl may also have the shape of a segment of a circle, of a truncated cone, of a truncated pyramid or the like. A forward pointing burl as an overhang has the advantage that the heel support structure may be constructed in a very stable manner. Moreover, in the case of shocks and impacts a burl is less prone to damage.

A cross section that runs horizontally through the forwardly overhanging heel support structure preferably has two forward pointing brackets that are disposed beside one another. The brackets herein, when viewed in the longitudinal direction of the ski, preferably have a larger extent than when viewed horizontally in the transverse direction of the ski. Thus, the brackets when viewed in the longitudinal direction of the ski may be configured in the shape of elongate bodies, similar to fingers, pegs, or pins, for example. The brackets herein may be configured so as to be mutually parallel. Likewise, said brackets in the distal region thereof may however also be spaced apart more or less widely than in the proximal region thereof, for example. Independently thereof, the two forward pointing brackets that are disposed beside one another have the advantage that the ski boot is reliably held in the automatic heel unit, since the connection between the ski boot and the heel support structure, when viewed in the transverse direction of the ski, is performed by way of a comparatively wide portion. This offers the skier additional safety.

Alternatively, there is the possibility for the horizontally running cross section to have no brackets. In this case, the heel support structure may have a salient or a bulge, for example, that overhangs toward the front.

Should a cross section that runs horizontally through the forwardly overhanging heel support structure have two forward pointing brackets that are disposed beside one another as an overhang, then a cross section that in the region of the in the horizontal cross section forward pointing brackets runs vertically in the transverse direction of the ski through the forwardly overhanging heel support structure preferably has two downwardly converging portions that are disposed beside one another. If, thus, the skier, in the step-in configuration of the automatic heel unit, introduces the heel region of the ski boot from above into the automatic heel unit, the heel region of the ski boot is automatically centered by the converging portions. On account thereof, simple and rapid introduction of the heel region of the ski boot into the heel support structure is enabled. Should the heel region of the ski boot herein not be supported in a downward direction toward the ski by a heel-block carrier that is separate from the downwardly converging portions of the heel support structure, the heel region of the ski boot may also additionally be supported in a downward direction toward the ski by the downwardly converging portions of the heel support structure. In order for these advantages to be achieved it is irrelevant whether the two downwardly converging portions, in the cross section that runs vertically in the transverse direction of the ski through the heel support structure, in the lower region thereof are interconnected or are mutually spaced apart.

Alternatively, that cross section that in the region of the in the horizontal cross section forward pointing brackets runs vertically in the transverse direction of the ski through the forwardly overhanging heel support structure may also have two differently configured portions. Thus, the two portions may also be disposed beside one another, for example, and in the vertical direction may be aligned so as to run mutually parallel.

The automatic heel unit preferably comprises a support unit by way of which the heel support structure is formed. The support unit in the holding configuration of the automatic heel unit serves for supporting the heel region of the ski boot that is held in the ski binding only in one direction that is horizontally transverse to the ski, or only both in a direction that is horizontally transverse to the ski as well as in a direction that is downward toward the ski. The support unit preferably comprises at least one element. In one variant thereof, the support element however comprises more than one element. Should the support unit have a plurality of elements, the latter may be interconnected or disposed so as to be spatially separated from one another. There is also the possibility for the support unit to comprise one or a plurality of elements which do not exert any support function. The support unit offers the advantage that the support function is exerted by one or a plurality of elements which are disposed separately from the heel downholding structure. On account thereof, these elements with a view to the function thereof may be constructed in an optimal manner.

Alternatively, there is the possibility for the automatic heel unit to not have any support unit. In this case, the heel support structure may be disposed, for example, on a surface of another element of the automatic heel unit, such as on the base, for example.

Should the automatic heel unit comprise a support unit, the support unit preferably comprises at least one support element, wherein the heel support structure is formed by the at least one support element. This has the advantage that the heel support structure may be constructed in a simple manner, since the heel support structure by way of a support element is adaptable to the mating structure of the heel region of the ski boot in a targeted manner.

Should the support unit herein comprise more than one support element, the heel support structure is preferably formed by these support elements. Herein, the forwardly overhanging heel support structure may be formed by one or by a plurality of the support elements. Independently of the number of support elements, the at least one support element in the holding configuration of the automatic heel unit is preferably configured for supporting the heel region of the ski boot that is held in the ski binding in a direction that is horizontally transverse to the ski. In one preferred variant thereof, at least one of the at least one support element is configured for supporting the heel region of the ski boot that is held in the ski binding in the holding configuration of the automatic heel unit both in a direction that is horizontally transverse to the ski as well as in a direction that is downward toward the ski. In one preferred variant thereof, all of the at least one support elements are configured for supporting the heel region of the ski boot that is held in the ski binding in the holding configuration of the automatic heel unit both in a direction that is horizontally transverse to the ski as well as in a direction that is downward toward the ski. As an alternative thereto, the at least one support element is configured for supporting the heel region of the ski boot that is held in the ski binding in the holding configuration of the automatic heel unit in a direction that is horizontally transverse to the ski, wherein however none of the at least one support elements is configured for supporting the heel region of the ski boot that is held in the ski binding in the holding configuration of the automatic heel unit both in a direction that is horizontally transverse to the ski as well as in a direction that is downward toward the ski. In the case of these variants it is irrelevant whether the support unit comprises further elements which do not exert any support function, and thus do not represent support elements.

Should a cross section that runs horizontally through the forwardly overhanging heel support structure have two forward pointing brackets that are disposed beside one another, the two brackets are preferably formed from a single support element. This allows simple construction and cost-effective manufacturing of the automatic heel units, using few components. In one preferred variant thereof, the two brackets are formed from two support elements. Herein, the two support elements each advantageously form one of the two brackets. This offers the advantage that the spacing between the support elements, measured horizontally in the transverse direction of the ski, can be set during fitting. Adapting the support unit to the heel region of the ski boot is thus possible.

As an alternative to these embodiments, there is the possibility for the support unit to not comprise any support element.

The automatic heel unit preferably comprises a tread spur for stepping into the automatic heel unit. The tread spur herein may be configured so as to be capable of being pushed down from above, so as to adjust the automatic heel unit from the step-in configuration, or from an optionally existing triggering configuration, to the holding configuration. This has the advantage that the skier may step into the automatic heel unit in a simple manner in that said skier by way of the heel region of the ski boot pushes the tread spur downward. There is the possibility herein for the tread spur in the holding configuration of the automatic heel unit to simultaneously serve as the heel-block carrier. However, there is also the possibility for the tread spur in the holding configuration of the automatic heel unit to not serve as the heel-block carrier. The tread spur is advantageously disposed on the heel downholder. This has the advantage that the heel downholder may be adjusted from the step-in position thereof to the holding position thereof by pushing the tread spur downward, so as to adjust the automatic heel unit from the step-in configuration, or an optionally existing triggering configuration, to the holding configuration. Alternatively thereto, the tread spur may also not be disposed on the heel downholder.

Should the automatic heel unit comprise a support unit having at least one support element, wherein the heel support structure is formed by the at least one support element, the tread spur may be formed by this at least one support element, or by the optionally existing plurality of support elements. The tread spur herein is a component part of the heel support structure. The tread spur herein is preferably rigid, that is to say immovable in relation to an at least one, forwardly overhanging part-region of the heel support structure that forms an overhang. The tread spur being formed by the at least one support element, or else by the optionally existing plurality of support elements, has the advantage that the tread spur may be manufactured in a simple and cost-effective manner, and moreover a compact construction mode of the automatic heel unit is enabled.

In one preferred variant thereof, the tread spur may however also be configured separately from the support unit. The tread spur herein may be configured so as to be rigid or movable in relation to the forwardly overhanging heel support structure. This has the advantage that the tread spur may be fitted or replaced, respectively, independently of the heel support structure. This allows individual adapting of the tread spur to the heel region of the ski boot in a downward direction toward the ski.

Should the automatic heel unit comprise a support unit having at least one support element, the at least one support element is advantageously mounted so as to be movable along an adjustment path in relation to the base. This has the advantage that the position of the at least one support element may be adapted to various sizes of ski boots. Should the heel downholding structure be movable in relation to the heel support structure, the at least one support element is moreover preferably movable along the adjustment path in relation to the base independently of the heel downholding structure. This has the advantage that, for example, stepping into the automatic heel unit can be facilitated in that the at least one support element is movable along the adjustment path during the step-in procedure when the automatic heel unit is adjusted from the step-in configuration to the holding configuration. It is irrelevant herein whether the adjustment path is curved or rectilinear. In one preferred variant, the adjustment path is configured so as to be curved. On account thereof, for example, the curvature of the adjustment path may be adapted to that curvature along which the heel region of the ski boot moves during the step-in procedure. In one preferred variant thereof, the adjustment path is configured so as to be also rectilinear. This has the advantage that guiding the at least one support element along the adjustment path is easy to establish. However, the adjustment path may also be shaped in an another manner.

As an alternative to the adjustment path, there is however also the possibility for the at least one support element to be immovable, and to be connected to the base, for example, in fixed or immovable manner, respectively.

Should the at least one support element be mounted so as to be movable along an adjustment path in relation to the base, the adjustment path is preferably aligned so as to be substantially vertical. This has the advantage that the at least one support element is movable from above by the skier, for example using a ski pole. Furthermore, the adjustment path is preferably aligned so as to be substantially in the direction of movement of the ski boot when stepping in, when the automatic heel unit is adjusted from the step-in configuration to the holding configuration. On account thereof, the heel region of the ski boot is already supported in a direction that is horizontally transverse to the ski during the step-in procedure.

Alternatively thereto, there is however also the possibility for the adjustment path to be aligned horizontally or in another direction.

Should the at least one support element be mounted so as to be moveable along an adjustment path in relation to the base, the support unit preferably comprises an elastic element by way of which the at least one support element is upwardly biased. The elastic element herein preferably comprises one or a plurality of springs for generating the bias. However, the elastic element may also be configured in a different manner. Independently thereof, the at least one biased support element offers the advantage that the latter is always in the topmost possible position in the adjustment path. Moreover, by the upward bias it may also be ensured that the at least one support element in the holding configuration of the automatic heel unit is always in contact with the ski boot that is held in the automatic heel unit, even in the case of dissimilar ski boot sizes.

Alternatively, there is however also the possibility for the support unit to be biased in another direction, for example in a downward direction. In one further embodiment, it is however also possible for the support unit to not comprise any elastic element by way of which the at least one support element is biased in an upward or any other direction. In this case, the support element may be manually adjustable to a desired position.

The automatic heel unit preferably enables safety triggering. This has the advantage that the safety of the skier is enhanced. On account of the fact that that the automatic heel unit according to the invention, as already mentioned, may be constructed in a space-saving manner in comparison to conventional automatic heel units by separating the heel support structure from the heel downholding structure, the automatic heel unit according to the invention additionally offers more space for the safety triggering mechanism. Accordingly, the safety triggering mechanism may be constructed in a more solid manner. In this way, the mechanism may be provided with a larger and stronger elastic element, for example. On account thereof, a stronger bias having accordingly high trigger values may be achieved for the ski binding. This enhances the safety of the skier in the case of a particularly sporty skiing style, such as in the case of so-called freeriding, for example.

In one preferred variant the automatic heel unit has a triggering configuration in which the automatic heel unit is adjustable in the case of safety triggering. The automatic heel unit after safety triggering is preferably located in this triggering configuration. The triggering configuration herein is different from the holding configuration. However, the triggering configuration is preferably identical with the step-in configuration. This has the advantage that the automatic heel unit may be constructed in a simple and cost-effective manner. However, in one preferred variant thereof, there is also the possibility for the triggering configuration to differ also from the step-in configuration. This has the advantage that the automatic heel unit by way of the step-in configuration is adaptable to the step-in procedure in a targeted manner, and on account thereof, stepping into the ski binding by the skier is facilitated.

As an alternative to these variants there is however also the possibility for the automatic heel unit to not enable safety triggering.

Should the automatic heel unit enable safety triggering, the automatic heel unit thus advantageously enables safety triggering in the forward direction. In the case of safety triggering in the forward direction, the heel region of the ski boot may be upwardly released from the automatic heel unit. This offers the advantage that the heel region of the ski boot in the case of safety triggering by virtue of a fall of the skier in the forward direction may be released by the automatic heel unit in a controlled manner.

In one further preferred embodiment the automatic heel unit enables lateral safety triggering. In the case of lateral safety triggering, the heel region may be laterally released from the automatic heel unit in a direction that is horizontally transverse to the ski. This offers the advantage that, in the case of lateral safety triggering by virtue of a lateral fall or of a fall with turning action of the skier, the heel region may be released horizontally from the automatic heel unit in the transverse direction of the ski in a controlled manner. Moreover, should the automatic heel unit comprise a support unit having at least one support element, the at least one support element for lateral safety triggering is preferably outwardly pivotable from a holding position. This has the advantage that the mechanism for lateral safety triggering may be constructed in a simple manner. Alternatively thereto, however, there is also the possibility for the support element to not be configured so as to be outwardly pivotable, and for lateral safety triggering to be enabled by another mechanism.

As an alternative to these variants, there is also the possibility for the automatic heel unit to enable safety triggering in the forward direction, as well as to enable lateral safety triggering.

Further advantageous embodiments and combinations of features of the invention are derived from the following detailed description and from the entirety of the patent claims.

BRIEF DESCRIPTION OF THE DRAWINGS

In the drawings used for explaining the exemplary embodiment.

In principle, same parts are provided with the same reference sign in the figures.

Ways of Implementing the Invention

Figure 1:
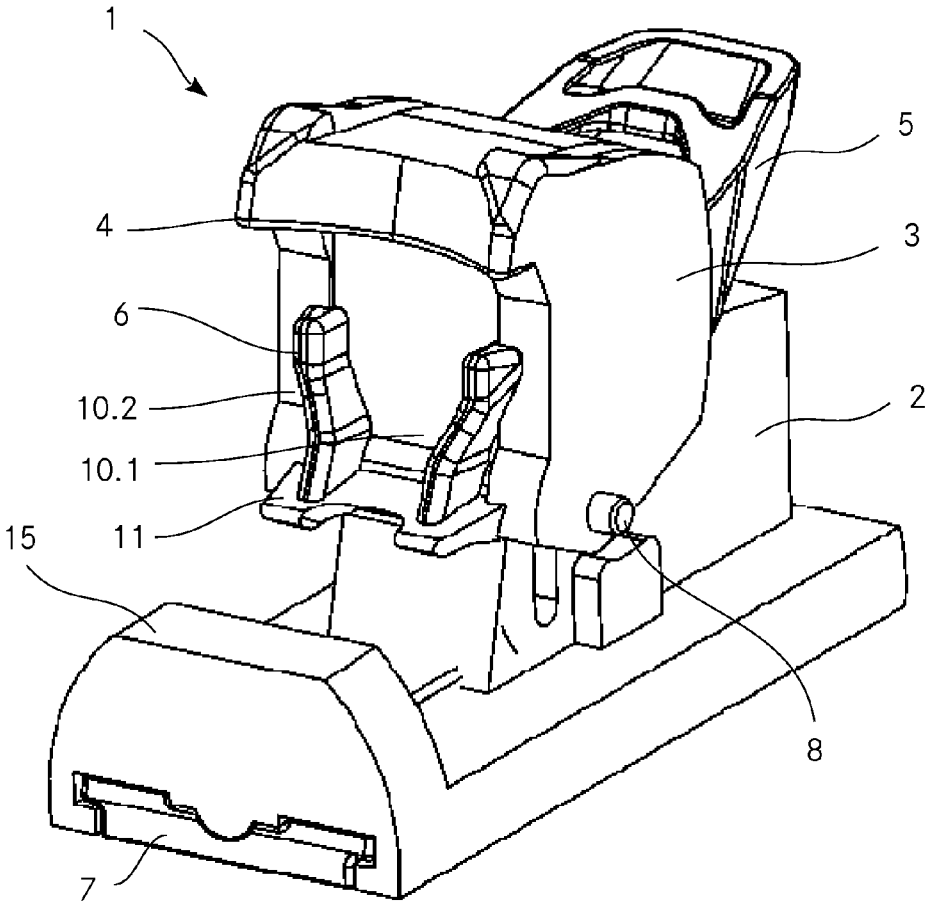
FIG. 1 shows an oblique view of an automatic heel unit according to the invention, in a step-in configuration in which the heel downholder is located in the step-in position thereof.

FIG. 1 shows an oblique view of an automatic heel unit 1 according to the invention, in a step-in configuration. A line that runs horizontally in the longitudinal direction from the front to the rear through the automatic heel unit 1 runs from the left lower to the right upper side in the figure. This line runs parallel with the longitudinal direction of a ski (not shown here) to which the automatic heel unit 1 may be fitted. Herein, the left lower side in the figure corresponds to front of the automatic heel unit 1. Top and bottom in the figure furthermore also correspond to the top and the bottom in the case of the automatic heel unit 1.

The automatic heel unit 1 is part of a ski binding which, apart from the automatic heel unit 1, also comprises an automatic front unit (not shown here) and in which a ski boot may be held. Herein the ski boot may be held both in the toe region thereof in the automatic front unit, as well as by way of the heel region thereof in the automatic heel unit 1, or else, depending on the construction of the automatic front unit, only by way of the toe region thereof in the automatic front unit.

The automatic heel unit 1 comprises a base plate 7 which serves as a base for fastening or fitting the automatic heel unit 1 to a ski, respectively. Furthermore, the automatic heel unit 1 comprises a slide 2, a heel downholder 3 having a heel downholding structure 4 for holding down a ski boot (not shown here) that is held in the ski binding in the heel region of the ski boot, a heel support structure 6 for supporting the heel region of the ski boot that is held in the ski binding in a direction that is horizontally transverse to the ski, and an opening lever 5. The slide 2 is mounted on the base plate 7 so as to be displaceable in the longitudinal direction of the ski, and when viewed in the longitudinal direction of the ski may be fixed to the base plate 7 in various positions so as to adapt the automatic heel unit 1 to ski boots of various sizes. The heel downholder 3 is mounted on the slide 2 so as to be pivotable on the slide 2 inter alia about an axle 8 that is horizontally aligned in the transverse direction of the ski. A heel-block carrier 15 for supporting in a downward manner toward the ski the heel region of the ski boot that is held in the ski binding is disposed in the front region of the slide 2.

In the step-in configuration of the automatic heel unit 1 the heel downholder 3, as is shown in FIG. 1, is located in a step-in position. Moreover, the opening lever 5 herein is located in a step-in position. Apart from this step-in configuration, the automatic heel unit 1 however also has a holding configuration. In this holding configuration of the automatic heel unit 1, the heel downholder 3 is located in a holding position which is different from the step-in position. Moreover, the opening lever 5 herein is located in a holding position. In the holding position, the heel downholder 3 by way of the heel downholding structure 4 may hold down the heel region 50 of a ski boot that is held in the ski binding in a lowered position, as is shown in FIG. 2*b*, and by way of the heel support structure 6 may support said heel region 50 in a direction that is horizontally transverse to the ski. By movement of the opening lever 5 from the holding position thereof to the step-in position thereof and back, the heel downholder 3 in relation to the slide 2 may be moved from the holding position thereof to the step-in position thereof and back. On account thereof, the automatic heel unit 1 may be adjusted from the holding configuration to the step-in configuration and back.

As can be seen in FIG. 1, the mounting of the heel downholder 3 by way of the axle 8 is located in a lower region of the heel downholder 3. It can moreover be seen in FIG. 1 that the heel downholding structure 4 is disposed in a front upper region of the heel downholder 3. The heel downholding structure 4 has the shape of a forwardly protruding segment. Herein, the segment is aligned in a horizontal plane and forms part of a circle of which the center lies in front of the heel downholder 3. In the holding position of the heel downholder 3, when a ski boot is held in the automatic heel unit 1, the segment-shaped heel downholding structure 4 bears on top of a rearwardly projecting sole region in the heel region of the ski boot. Herein, a round heel region of the ski boot is partially enclosed from behind by the heel downholding structure 4, so as to laterally reach somewhat to the front. However, the heel downholding structure 4 does not necessarily have to be segment-shaped. Said heel downholding structure 4 may also be rectilinearly shaped, for example, and be horizontally aligned in the transverse direction of the ski and thus encompass the heel region of the ski boot so as not to reach laterally to the front. Independently of the shaping thereof, the heel downholding structure 4 holds down the heel region of the ski boot in that the former pushes down the rearwardly projecting sole region. The heel downholding structure 4 thus prevents the heel region of the ski boot from moving in a vertically upward direction.

The heel downholder 3 on an adjustment path in relation to the slide 2 as well as in relation to the base plate 7 is movable from the holding position thereof to the step-in position thereof and back. The heel downholder 3 herein in a first region of the adjustment path is movably vertically upward. In this first region of the adjustment path, the heel downholder 3 is biased by a vertically downward pushing spring (not shown here) toward the holding position of the former. As soon as the heel downholder 3, starting from the holding position thereof, has been moved upward sufficiently far along this first region of the adjustment path, counter to the spring force, the heel downholder 3 may be pivoted rearward about the axle 8 along a second region of the adjustment path, such that the heel region 50 of the ski boot is released by the heel downholder 3.

This motion sequence of the heel downholder 3 is performed both when adjusting the automatic heel unit 1 from the holding configuration to the step-in configuration, as well as in the case of safety triggering in the forward direction that is enabled by the automatic heel unit 1. Herein, the energy that in the case of a shock acting on the ski boot, the ski binding, or the ski, may be absorbed by the automatic heel unit 1 prior to safety triggering in the forward direction arising, depends on the force of the spring as well as on the length of the first region of the adjustment path.

The forwardly overhanging heel support structure 6 is located in a front lower region of the heel downholder 3. The heel support structure 6 is configured separately from the heel downholding structure 4, wherein the former, like the heel downholding structure 4, however is disposed on the heel downholder 3. By contrast to the heel downholding structure 4, the heel support structure 6 is configured for supporting the heel region of the ski boot only in a direction that is horizontally transverse to the ski. To this end, the heel support structure 6 comprises two forwardly projecting overhangs 10.1, 10.2 which when viewed in the vertical direction are elongate. These overhangs 10.1, 10.2 in a cross section that runs horizontally through the overhangs 10.1, 10.2 form two forward pointing brackets which are disposed beside one another. The heel support structure 6 furthermore comprises a horizontal tread spur 11. The tread spur 11 herein is disposed on a lower end of the overhangs 10.1, 10.2. The overhangs 10.1, 10.2, and the tread spur 11, in the embodiment of the automatic heel unit 1 shown in FIG. 1 are fixedly connected to the heel downholder 3. The overhangs 10.1, 10.2 are disposed so as to be mutually spaced apart when measured horizontally in the transverse direction of the ski. Moreover, said overhangs 10.1, 10.2 in a cross section that runs vertically in the transverse direction of the ski through the overhangs 10.1, 10.2 form two downwardly converging portions.

Figure 2A:
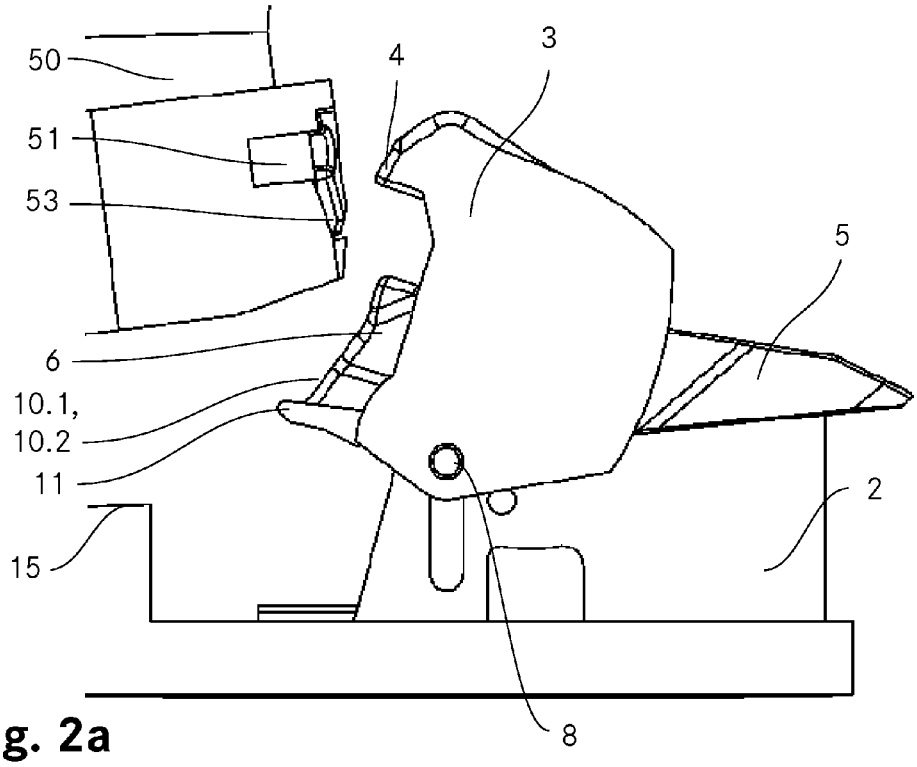
FIG. 2*a* shows a side view of the automatic heel unit according to the invention, in the step-in configuration with a heel region of a ski boot.
Figure 2B:
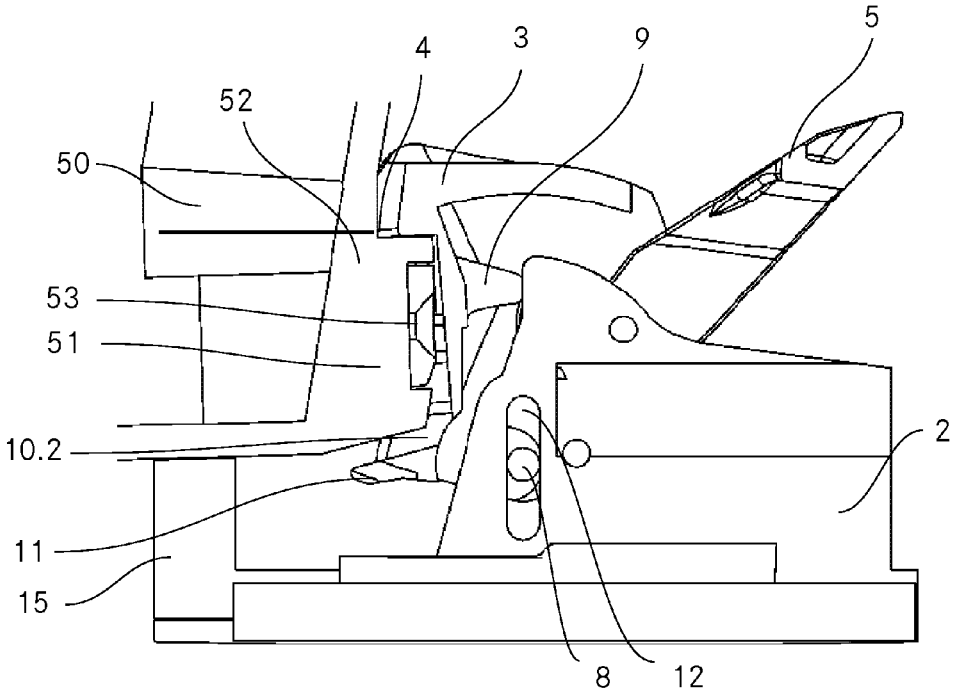
FIG. 2*b* shows a view of a vertically aligned cross section running in the longitudinal direction of the ski through the automatic heel unit in a holding configuration in which the heel downholder is located in the holding position thereof, together with the heel region of the ski boot.

FIG. 2*a* shows a side view of the automatic heel unit 1 in the step-in configuration. Moreover, the heel region 50 of a ski boot that is to be held in the automatic heel unit 1 is illustrated in FIG. 2*a*. The ski boot in the heel region 50 thereof has a mating structure 51 having clearances and a structure element 53. Herein, the structure element 53 in relation to a width of the ski boot is located in the center, while one clearance is disposed on each of the two sides of the structure element 53. The overhangs 10.1, 10.2 of the heel support structure 6 are configured for engaging in the clearances of the mating structure 51 in the heel region 50 of the ski boot that is held in the ski binding in the holding configuration of the automatic heel unit 1, so as to support the heel region 50 only in a direction that is horizontally transverse to the ski. In the step-in configuration of the automatic heel unit 1, shown in FIG. 2*a*, the heel downholder 3 is located in the step-in position thereof. This means that the heel downholder 3 is located in an upper, rearwardly inclined position. The opening lever 5 herein is located in the step-in position in which the former is located in a lower, almost horizontal position. Positioning of the heel region 50 of the ski boot in the automatic heel unit 1 for stepping in is facilitated by the rearwardly inclined heel downholder 3.

The position of the heel region 50 of the ski boot as is shown in FIG. 2*a* corresponds to the position of the heel region 50 shortly prior to stepping into the automatic heel unit 1. For stepping in, the heel region 50 of the ski boot is moved under the segment-shaped heel downholding structure 4 and above the tread spur 11 such that the overhangs 10.1, 10.2 of the heel support structure 6 protrude into the clearances of the mating structure 51 of the heel region 50.

If and when the ski boot is positioned in the automatic heel unit 1, that is to say that the heel region 50 of the ski boot is located under the segment-shaped heel downholding structure 4 and on the tread spur 11, the tread spur 11 may be pushed downward by the ski boot. On account thereof, the heel downholder 3 is first pivoted along the third region of the adjustment path about the axle 8 to be front, so as to be thereafter moved along the second and the first region of the adjustment path downward, on account of which the heel downholding structure 4, as has already been described, pushes the rearwardly projecting sole region 52 in the heel region 50 of the ski boot downward and, on account thereof, holds said sole region in a lowered position.

Apart from this step-in with the ski boot, by depressing the tread spur 11, the automatic heel units 1 may also be adjusted from the step-in configuration to the holding configuration and back in that the opening lever 5 is pivoted from the step-in position thereof upward to the holding position thereof and back, as has already been mentioned. Herein, stepping in or stepping out of the automatic heel unit 1 by way of a ski boot may be simultaneously performed.

FIG. 2*b* shows a side view of a section running in the longitudinal direction of the ski through the automatic heel unit 1 in the holding configuration. The opening lever 5 is located in the holding position thereof, and the heel downholder 3 is located in the holding position.

The axle 8 which is aligned horizontally in the transverse direction of the ski can be identified in the lower region of the heel downholder 3 in FIG. 2*b*. The heel downholder 3 by way of this axle 8 is movably mounted on the slide 2. To this end, the axle 8 is aligned horizontally in the transverse direction of the ski and runs through a slot 12 in the slide 2. The slot 12 is vertically aligned and forms a positive guide for the axle 8.

Apart from the axle 8, a rearward pointing stop element 9 which is disposed in the interior of the heel downholder 3 in an upper region of the heel downholder 3 can be identified in FIG. 2*b*. The heel downholder 3 is movably mounted on the slide 2 also by way of this stop element 9. By contrast to the axle 8 that is guided in the slot 12, the stop element 9 however is supported on a forward pointing face of the slide 2 that is aligned so as to be substantially vertical. This face forms a substantially vertical positive guide for the stop element 9. By contrast to the slot 12 which is delimited at the bottom and the top and thus enables movement of the axle 8 only within a limited region, the forward pointing face of the slide 2 delimits movement of the stop element 9 only toward the rear. Therefore, the movement of the heel downholder 3 along the first region of the adjustment path is determined both by the guiding of the axle 8 in the slot 12, as well as by the positive guiding of the stop element 9 on the forward pointing face of the slide 2. Herein, however, the downward and upward freedom of movement of the heel downholder 3 is delimited by the guide of the axle 8 about the slot 12. Thus, the heel downholder 3 can only be raised upward so far until the stop element 9 has been raised just above the forward pointing face of the slide 2 and may be moved rearwardly downward along a rearwardly downwardly inclined face of the slide 2 that adjoins the upper periphery of the face. The heel downholder 3 herein is rearwardly pivoted about the axle 8. By way of an elastic element in the form of a spring (not shown here), the heel downholder 3 is biased toward the holding position thereof, in that the spring pushes the axles 8 downward in the slot 12. This means that the heel downholder 3 for adjusting from the holding position thereof to the step-in position thereof first has to be moved upward, counter to the force generated by the biased spring, along the first region of the adjustment path. The heel downholder 3 may be rearwardly pivoted along the second region of the adjustment path only once the stop element 9 at the top has been raised above the forward pointing face of the slide 2.

By virtue of these kinematics, the heel downholder 3 cannot be unintentionally released from the holding position. Moreover, the automatic heel unit 1 by way of the biased spring enables safety triggering in the forward direction. In the case of a fall, should the energy that acts on the ski boot, the ski, or the ski binding be greater than the force of the biased spring multiplied by the length of the first two regions of the adjustment path, safety triggering arises in that the heel downholder 3 is moved from the holding position thereof to the step-in position thereof. On account thereof, the heel region 50 of the ski boot is released by the automatic heel unit 1. For example, such safety triggering of a heel downholder having similar kinematics is also described in WO 96/23559 A1 (Fritschi AG Apparatebau).

It can be further seen in FIG. 2*b* that the segment-shaped heel downholding structure 4 in the holding position of the heel downholder 3 bears at the top on the rearwardly projecting sole region 52 in the heel region 50 of the ski boot. On account thereof, the heel downholding structure 4 prevents the heel region 50 from moving in a vertically upward direction away from the ski, and holds down the heel region 50 of the ski boot.

By contrast to the heel downholding structure 4, the overhangs 10.1, 10.2 of the heel support structure 6 are configured in such a manner that the former in the holding configuration of the automatic heel unit 1 support the heel region 50 of the ski boot that is held in the ski binding only in a direction that is horizontally transverse to the ski. Herein, the overhangs 10.1, 10.2 of the heel support structure 6 on both sides of the ski interact in a completely form-fitting manner with the clearances and the structure element 53 of the mating structure 51 of the heel region 50. On account thereof, the overhangs 10.1, 10.2 prevent the heel region 50 from freely moving in a lateral manner, this is to say from freely moving in a direction that is horizontally transverse to the ski.

Depending on the embodiment of the automatic heel unit 1, the heel region 50 of the ski boot in the holding configuration of the automatic heel unit 1 may be movable in a limited region of 0.5 mm to 1.5 mm, for example, in a direction that is horizontally transverse to the ski in relation to the heel downholding structure 4. In the present case this means that the spacing measured in the transverse direction of the ski between the overhangs 10.1, 10.2 may be slightly larger than the width of the structure element 53 that is disposed between the clearances in the heel region 50 and that in the holding position of the heel downholder 3 lies between the overhangs 10.1, 10.2. Depending on the embodiment of the automatic heel unit 1, the heel region 50 in the holding configuration of the automatic heel unit 1 may also only be movable in relation to the heel downholding structure 4 within a region that results from the production tolerances of the heel support structure 6 as well as of the heel downholding structure 3. The overhangs 10.1, 10.2 thus block free movement of the heel region 50 of the ski boot that is held in the ski bindings in a direction that is horizontally transverse to the ski. Independently of the embodiments mentioned herein, the ski boot in any case is introducible in between the overhangs 10.1, 10.2, on account of which the function of the heel support structure 6 is guaranteed.

Apart from the heel downholding structure 4 and the heel support structure 6, the automatic heel unit 1, as has already been mentioned, also has a tread spur 11 which is disposed on the heel downholder 3. This tread spur 11 serves for moving the automatic heel unit 1 from the step-in configuration thereof to the holding configuration thereof, as has been described above. The tread spur 11 may moreover serves as a vertical stop when stepping into the automatic heel unit 1, so as to be able to more readily position the ski boot in the automatic heel unit 1. Should the heel downholder 3 be moved to the holding position thereof, the tread spur 11 together with the heel downholder 3 pivots forward or downward, respectively, since the tread spur 11 is immovable in relation to the heel downholder 3. However, the tread spur 11 does not touch the heel region 50 of the ski boot in the holding position of the heel downholder 3, because the heel region 50 of the ski boot is supported on the heel-block carrier 15.

FIGS. 3*a* to 3*d* show a further embodiment of an automatic heel unit 101 according to the invention, wherein the base plate of the automatic heel unit 101 that serves as the base is not shown, however. This automatic heel unit 101 comprises substantially the same elements as the automatic heel unit 1 shown in FIGS. 1, 2*a*, and 2*b*. By contrast to the automatic heel unit 1, however, the automatic heel unit 101 comprises a support unit 113 that is separate from the heel downholder 103 and that comprises a support element on which the heel support structure 6 is configured.

Figure 3A:
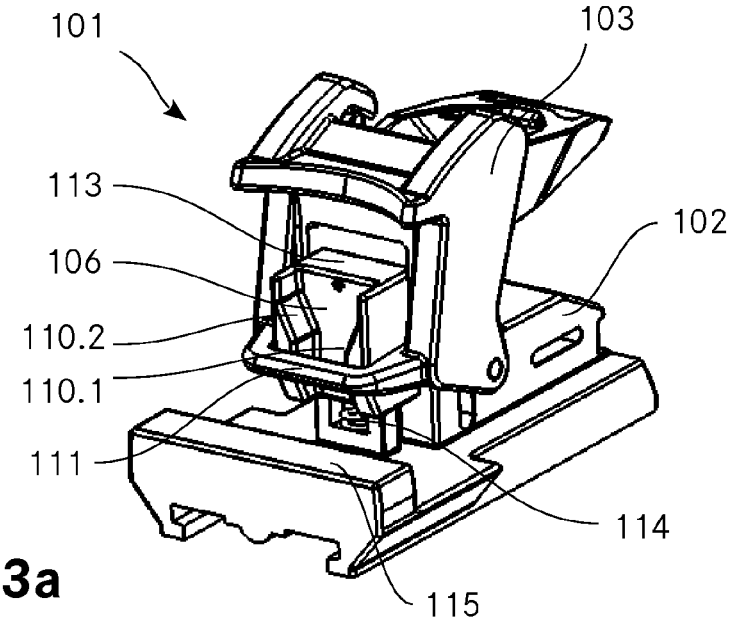
FIG. 3*a* shows an oblique view of a further embodiment of an automatic heel unit according to the invention, in the step-in configuration.

FIG. 3*a* shows an oblique view of the automatic heel unit 101 in the step-in configuration. In an analogous manner to the oblique view in FIG. 1, bottom left in FIG. 3*a* corresponds to the front of the automatic heel unit 101. Top and bottom in FIG. 3*a* also correspond to the top and the bottom of the automatic heel unit 101.

It can be seen in FIG. 3*a* that the support element of the support unit 113 is not fixedly connected to the heel downholder 103, but is movably mounted on the slide 102. Herein, the support element is movable in the vertical direction along a rectilinear adjustment path in relation to the base, to the heel downholder 103, and to the slide 102. The heel support structure 6 in this embodiment shown, as has already been mentioned, is disposed on the support element of the support unit 113. Said heel support structure 6, when viewed in the vertical direction, has two elongate overhangs 110.1, 110.2 which overhang to the front of the support element. These overhangs 110.1, 110.2 serve, in the holding configuration of the automatic heel unit 101, for supporting the heel region 50 of the ski boot that is held in the ski binding in a direction that is horizontally transverse to the ski.

As opposed to the automatic heel unit 1 that has been previously described, the tread spur 111 in the case of the present automatic heel unit 101 is not connected to the overhangs 110.1, 110.2, but is disposed on the heel downholder 103. This means that the tread spur 111 in this embodiment is movable in relation to the overhangs 110.1, 110.2. As in the case of the automatic heel unit 1, the tread spur 111 serves for moving the automatic heel unit 101 from the step-in configuration thereof to the holding configuration thereof. Moreover, said tread spur 111 may serve as a vertical stop when positioning the ski boot downward toward the ski. If and when the heel downholder 103 is moved to the holding position thereof, the tread spur 111 together with the heel downholder 103 pivots forward or downward, respectively, because the tread spur 111 is immovable in relation to the heel downholder 103. The tread spur 111 in the holding position of the heel downholder 103 however does not touch the heel region 50 of the ski boot, because the heel region 50 of the ski boot is supported on the heel-block carrier 115.

Apart from the support element, the support unit 113 also comprises an elastic element in the form of a spring 114. By way of this spring 114 the support unit is upwardly biased away from the ski. Since the overhangs 110.1, 110.2 of the support unit 113, as is the case with the embodiment of the automatic heel unit 1 that has been previously described, in a cross section that runs vertically through the overhangs 110.1, 110.2 in a transverse direction of the ski form downwardly converging portions, said overhangs 110.1, 110.2 in downward manner toward the ski also serve as a bearing face for the heel region 50 of the ski boot. Thus, when the heel region 50 of the ski boot in the step-in configuration of the automatic heel unit 101 is introduced into the automatic heel unit 101, and the automatic heel unit 101 is adjusted to the holding configuration, the heel region 50 of the ski boot bears on the overhangs 110.1, 110.2 and pushes the support element somewhat downward, counter to the bias of the spring 114. However, by virtue of the spring 114 the support element is held in the topmost highest position thereof. On account thereof it is ensured that the overhangs 110.1, 110.2 and thus the heel support structure 103 always interacts with the heel region 50 of the ski boot in a form-fitting manner on both sides of the said heel region in a direction that is horizontally transverse to the ski.

As has already been mentioned, the heel region 50 of the ski boot that in the holding configuration is held in the automatic heel unit 101 in the case of the automatic heel unit 101 is downwardly supported toward the ski by the heel-block carrier 115. However, there is also the possibility for the heel region 50 of the ski boot that in the holding configuration is held in the automatic heel unit to be downwardly supportable toward the ski by overhangs of the heel support structure instead of by a heel-block carrier. Should the overhangs, as is the case in the two above described automatic heel units 1, 101, in a cross section that runs vertically in the transverse direction of the ski through the overhangs form downwardly converging portions, the heel region 50 of the ski boot in the holding configuration may also be supported by these overhangs, for example.

Figure 3B:
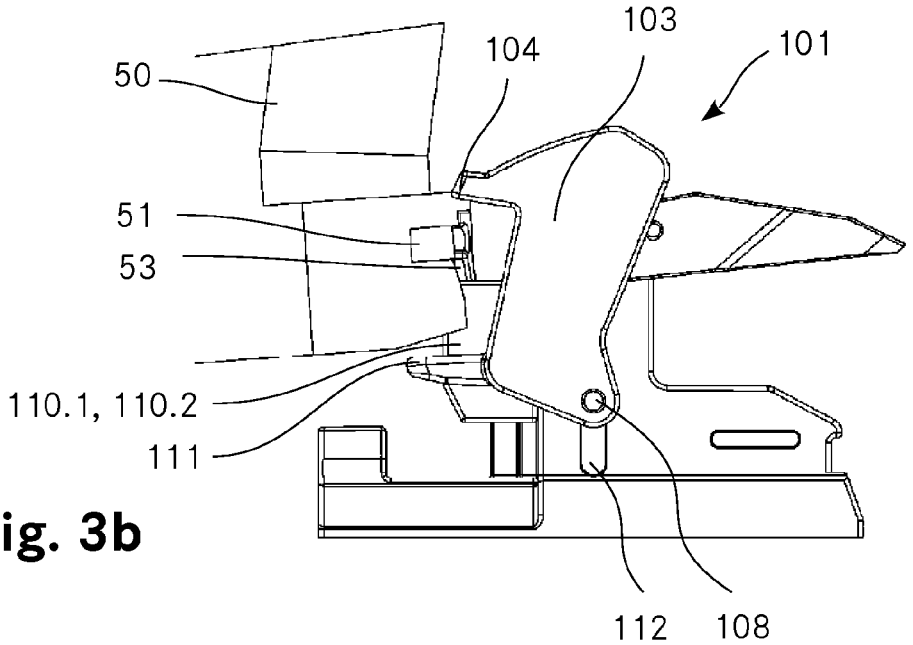
FIG. 3*b* shows a side view of the further automatic heel unit in the step-in configuration, with the heel region of the ski boot.

FIG. 3*b* shows a side view of the automatic heel unit 101 in the step-in configuration, together with the heel region 50 of the ski boot. The shown position of the heel region 50 corresponds to the position of the heel region 50 shortly before the ski boot is introduced into the automatic heel unit 101.

By way of the upward bias, the support element of the support unit 113 in the step-in position is located at an upper end of the vertical displacement path thereof. Likewise, the axle 108 of the heel downholder 103 is located at an upper end of the slot 112. On account thereof, the heel downholder 103 in the step-in position is likewise located in an upper position.

Figure 3C:
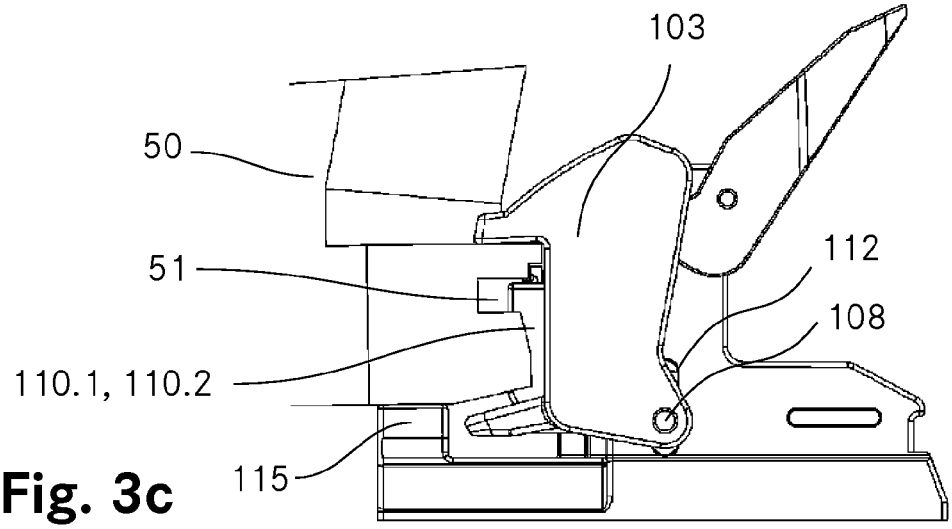
FIG. 3*c* shows a side view of the automatic heel unit in the holding configuration, with the heel region of the ski boot.

FIG. 3*c* shows the automatic heel unit 101 in the holding configuration. The heel downholder 103 in the holding position thereof is pivoted to the front, and the axle 108 is located in the lower first region of the adjustment path. Moreover, the support element of the support unit 113 is also moved somewhat downward. By way of the bias of the spring 114, the support element of the support unit 113 is however pushed from below upward against the mating structure 51 of the heel region 50 of the ski boot that is held in the ski binding. On account thereof, it is ensured that the overhangs 110.1, 110.2 are at all times in contact from below and on both sides with the clearances of the mating structure 51. On account thereof, the mating structure 51 during the entire time in which the automatic heel unit 101 is located in the holding configuration, and in which the ski boot is held in the automatic heel unit 101, interacts horizontally on both sides in a form-fitting manner with the heel support structure 106. It can moreover be seen in FIG. 3*c* that the heel region 50 of the ski boot in a direction downward toward the ski is supported by the heel-block carrier 115.

Figure 3D:
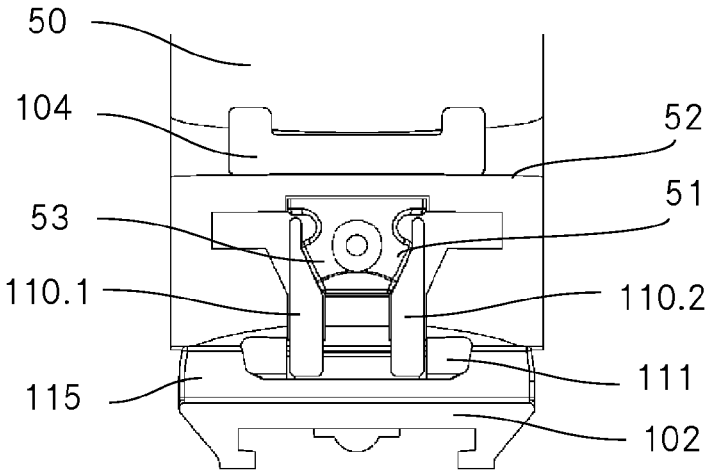
FIG. 3*d* shows a view of a vertically aligned cross section that runs in the transverse direction of the ski through a heel support structure of the further automatic heel unit in the holding configuration, with the heel region of the ski boot.

FIG. 3*d* shows a view from the rear to the front onto a vertically aligned section that runs in the transverse direction of the ski through the automatic heel unit 101 in the holding configuration, with a ski boot that is held in the ski binding.

The section herein runs through a front region of the automatic heel unit 101, such that said section runs through the forwardly projecting heel downholding structure 104 and through the overhangs 110.1, 110.2 of the heel support structure.

It can be seen in FIG. 3*d* that the circular heel downholding structure 104 spans the rearwardly projecting sole region 52 in the heel region 50 of the ski boot, and thus holds down the heel region 50. Moreover, it can be identified that the mating structure 51 of the heel region 50 of the ski boot between the clearances has a V-shaped structure element 53 having two lateral faces. In a cross section that runs vertically in the transverse direction of the ski through the structure element 53, the lateral faces of the structure element 53 converge from the top to the bottom. The V-shaped structure element 53 in the holding position of the heel downholder 103 by way of the lateral faces of the former bears in a form-fitting manner on internal faces of the overhangs 110.1, 110.2 of the heel support structure 106. The internal face of the overhangs 110.1, 110.2 in relation to the vertical is at the same angle as the lateral faces of the structure element 53. In the holding position of the heel downholder 103, both lateral faces of the structure element 53 are in contact with the internal faces of the overhangs 110.1, 110.2. On account thereof, the heel region 50 is held in a form-fitting manner on both sides in a direction that is horizontally transverse to the ski. The heel-block carrier 115 of the slide 102 supports the heel region 50 in a direction downward toward the ski.

The V-shaped structure element 53 of the mating structure 51 in an upper region has clearances. On account thereof it is ensured that the structure element 53 by way of the faces thereof in the holding position of the heel downholder 103 completely bears on the internal faces of the overhangs 110.1, 110.2 Reliable holding of the heel region 50 of the ski boot in the automatic heel unit 1 is thus guaranteed.

The heel region 50 of the ski boot by way of the structure element 53 of the mating structure 51 and by the overhangs 110.1, 110.2 of the heel support structure 106 is thus supported only in a direction that is horizontally transverse to the ski, and by the heel-block carrier 115 of the slide 102 in a direction downward toward the ski. Moreover, the heel region 50 of the ski boot by way of the rearwardly projecting sole region 52 in the heel region 50 of the ski boot is held down by the segment-shaped heel downholding structure 104.

The invention is not limited to the two automatic heel units 1, 101 as have been described above. For example, it is not necessary for the automatic heel unit as described above to comprise a slide which is displaceable on the base. Also, it is not required that the heel downholder is mounted directly on the optionally existing slide. For employment in a touring ski binding of the first type mentioned at the outset, the heel downholder may for example also not be disposed directly on the ski, but as has been described in WO 96/23559 A1 (Fritschi AG Apparatebau) on a sole carrier which in a front region thereof is mounted on the ski so as to be pivotable about an axle that is aligned horizontally in the transverse direction of the ski.

Besides being employed in touring ski bindings, Telemark or cross-country ski bindings, an automatic heel unit according to the invention may also be employed in other ski bindings such as downhill bindings, for example.

Independently of the type of ski binding in which the automatic heel unit is employed, there is also the possibility for the heel downholder together with the heel downholding structure and the slide to be able to be integrally configured as one element. The heel support structure may be configured so as to be movable or fixed in relation to this integral element. There is thus the possibility for the heel support structure to be disposed directly on the slide. Alternatively, the heel support structure may not be disposed on the heel downholder but form a discrete element of the automatic heel unit.

However, the invention may be embodied so as to deviate from the above-described automatic heel unit 1, 101 in other ways. For example, the heel support structure does not mandatorily have to comprise a tread spurt. Furthermore, there is the possibility for the heel support structure to not comprise two but only one or more than two overhangs.

Should the heel support structure comprise two overhangs, the latter need not be disposed so as to be downwardly converging, as has been described. The overhangs may also be mutually parallel or at any other arbitrary angle. The heel support structure may for example also comprise only two individual pegs which forwardly overhang from the heel downholder. Moreover, there is the possibility for the heel support structure to displaceable in relation to the base plate 7 together with the ski boot that is held in the ski binding in a limited region in a direction that is horizontally transverse to the ski.

Independently thereof, the heel support structure does not have to interact in a form-fitting manner with the mating structure of the heel region of the ski boot, as has been described above. The connection between the automatic heel unit and the ski boot may also be performed in a force-fitting or a form-fitting and force-fitting manner. Moreover, the heel region of the ski boot does not have to have a mating structure. The heel support structure may also be configured such that the former interacts directly with a rear end of the heel region of the ski boot.

Should the heel support structure be movable and capable of being biased, another elastic element than the spring 114 may also be employed. Moreover, there is also the possibility for the heel support structure to not be biased in an upward direction but in another alignment.

Furthermore, the described adjustment path of the support element of the support unit may also not be aligned in the vertical but in an oblique or horizontal direction, for example. Moreover, the adjustment path may also be configured so as to be curved.

In summary, it may be stated that an automatic heel unit which is of light construction and nevertheless allows a sporty skiing style of the skier is provided.

The invention claimed is:

1. Automatic heel unit for a ski binding, in particular a touring ski binding, comprising a base for fitting the automatic heel unit on a ski and a heel downholder having a heel downholding structure for holding down a ski boot that is held in the ski binding in a heel region of the ski boot, wherein the heel downholder is mounted so as to be movable in relation to the base, and wherein a) the automatic heel unit has a holding configuration in which the heel downholder is located in a holding position and the heel downholding structure may interact with the heel region of the ski boot that is held in the ski binding in such a manner that the heel region of the ski boot is held down in a lowered position, and wherein b) the automatic heel unit has a step-in configuration in which the heel downholder is located in a step-in position and the heel region of the ski boot is released by the heel downholding structure, wherein the automatic heel unit comprises a forwardly overhanging heel support structure, which is configured separately from the heel downholding structure, for supporting the heel region of the ski boot that is held in the ski binding in the holding configuration of the automatic heel unit only in one direction that is horizontally transverse to the ski, or only both in a direction that is horizontally transverse to the ski as well as in a direction that is downward toward the ski, wherein a cross section that runs horizontally through the forwardly overhanging heel support structure has two forward pointing brackets that are disposed beside one another.

2. Automatic heel unit according to claim 1, wherein the heel support structure is shaped such that the heel support structure in the holding configuration of the automatic heel unit in a direction that is horizontally transverse to the ski always interacts with the heel region of the ski boot in a form-fitting manner on both sides.

3. Automatic heel unit according to claim 1, wherein the heel support structure is configured, in the holding configuration of the automatic heel unit, for holding the heel region of the ski boot that is held in the ski binding in a direction that is horizontally transverse to the ski in relation to the heel downholding structure.

4. Automatic heel unit according to claim 1, wherein the heel support structure is configured, in the holding configuration of the automatic heel unit, for allowing movement of the heel region of the ski boot that is held in the ski binding in a direction that is horizontally transverse to the ski within a limited region in relation to the heel downholding structure.

5. Automatic heel unit according to claim 1, wherein the heel support structure is disposed on the heel downholder.

6. Automatic heel unit according to claim 1, wherein the heel support structure is configured separately from the heel downholder.

7. Automatic heel unit according to claim 1, wherein the heel downholding structure is fixedly disposed in relation to the heel support structure.

8. Automatic heel unit according to claim 1, wherein the heel downholding structure is movable in relation to the heel support structure.

9. Automatic heel unit according to claim 1, wherein a cross section that runs horizontally through the forwardly overhanging heel support structure has a forward pointing bracket.

10. Automatic heel unit according to claim 1, wherein the automatic heel unit comprises a support unit by way of which the heel support structure is formed.

11. Automatic heel unit according to claim 10, wherein the support unit comprises at least one support element, wherein the heel support structure is formed by the at least one support element.

12. Automatic heel unit according to claim 11, wherein the at least one support element is mounted so as to be movable along an adjustment path in relation to the base.

13. Automatic heel unit according to claim 12, wherein the support unit comprises an elastic element by way of which the at least one support element is upwardly biased.

14. Automatic heel unit according to claim 1, wherein the automatic heel unit enables safety triggering.

15. Automatic heel unit according to claim 1, wherein a cross section that in the region of the horizontal cross section forward pointing brackets runs vertically in the transverse direction of the ski through the forwardly overhanging heel support structure and has at least two downwardly converging portions that are disposed beside one another.

* * * * *